US011603264B2

(12) United States Patent
McNeilus et al.

(10) Patent No.: US 11,603,264 B2
(45) Date of Patent: Mar. 14, 2023

(54) REFUSE COLLECTION VEHICLE HAVING CUSTOMIZED LOAD EDGE

(71) Applicant: Con-Tech Manufacturing, Inc., Dodge Center, MN (US)

(72) Inventors: Grant McNeilus, Dodge Center, MN (US); Garwin McNeilus, Dodge Center, MN (US); Jay Attleson, Rochester, MN (US); Aaron J. Hoff, Dodge Center, MN (US); Brian Meldahl, Brownsdale, MN (US)

(73) Assignee: Con-Tech Manufacturing, Inc., Dodge Center, MN (US)

( * ) Notice: Subject to any disclaimer, the term of this patent is extended or adjusted under 35 U.S.C. 154(b) by 0 days.

(21) Appl. No.: 17/146,393

(22) Filed: Jan. 11, 2021

(65) Prior Publication Data

US 2022/0219895 A1 Jul. 14, 2022

(51) Int. Cl.
*B65F 3/04* (2006.01)
*B65F 3/02* (2006.01)

(52) U.S. Cl.
CPC ..... *B65F 3/04* (2013.01); *B65F 3/0213* (2013.01); *B65F 2003/025* (2013.01)

(58) Field of Classification Search
CPC ..... B65F 3/00; B65F 3/0213; B65F 3/041; B65F 2003/006; B65F 2003/0263
See application file for complete search history.

(56) References Cited

U.S. PATENT DOCUMENTS

| | | | | |
|---|---|---|---|---|
| 5,447,405 | A | 9/1995 | Bayne et al. | |
| 9,561,904 | B1 * | 2/2017 | Osborn | B65F 3/041 |
| 2005/0169734 | A1 * | 8/2005 | Arrez | B65F 3/041 414/406 |
| 2020/0198888 | A1 * | 6/2020 | Steimel | B66D 1/60 |

FOREIGN PATENT DOCUMENTS

| | | | | |
|---|---|---|---|---|
| EP | 0612674 | A1 * | 8/1994 | B65F 3/00 |
| EP | 0690014 | A1 * | 1/1996 | B65F 3/0213 |
| EP | 1167242 | A1 * | 1/2002 | B65F 3/04 |
| FR | 1166318 | A * | 11/1958 | B65F 3/041 |
| GB | 2078196 | A * | 1/1982 | B65F 3/0213 |
| GB | 2404178 | A * | 1/2005 | B65F 3/0213 |
| KR | 100963567 | B1 * | 6/2010 | B65F 3/041 |
| NL | 9202005 | A * | 6/1994 | B65F 3/0213 |
| WO | WO-9529111 | A1 * | 11/1995 | B65F 3/00 |

* cited by examiner

*Primary Examiner* — James Keenan
(74) *Attorney, Agent, or Firm* — Larkin Hoffman Daly & Lindgren, Ltd.; Craig J. Lervick

(57) ABSTRACT

A refuse collection vehicle includes a collection mechanism having a collection hopper which accommodates the collection of refuse by dumping into the collection hopper. A bolt-on load edge bracket is configured to be attached to a portion of the collection mechanism adjacent the collection hopper, is capable of defining an adjustable rear load edge based upon where the attachment is made. By using a separate bolt-on load edge bracket, the rear of the collection vehicle can be tailored to accommodate various load edge heights, and to allow several alternative tipper mechanisms to be the easily attached thereto.

20 Claims, 4 Drawing Sheets

REFUSE COLLECTION VEHICLE HAVING CUSTOMIZED LOAD EDGE

BACKGROUND

Heavy duty mechanical equipment used throughout the world typically includes a unique combination of work pieces, related power supplies and robust components specifically configured to withstand harsh operating environments. In many situations, this equipment includes specially designed mechanical components (i.e. levers, working surfaces, housings, shields, brackets, etc.) and related power actuators (e.g. hydraulic cylinders). In practice, the mechanical systems are all uniquely designed to carry out the desired motions/functions, meet the specific needs of the device, or provide appropriate protection.

As mentioned, one application where mechanical systems are used in such harsh conditions is the refuse truck. These trucks include systems to accommodate the collection, packing and transport of refuse. The collection and packing (i.e. compaction) systems often require the use of mechanical components and/or systems such as those highlighted above.

Although many refuse trucks share common design features, variations do exist depending on the way they are used, and many other factors. For example, collection companies typically dictate the type of containers used by their customers use to ensure that they properly cooperate with pick-up mechanisms or "tippers". For rear load collection trucks, the tippers are mounted to a load edge of the collection compartment, and generally configured so that an operator can roll a collection container to the load edge, and then actuate the tipper. Upon actuation of the tipper, the container is then slightly lifted and dumped into the collection compartment of the truck. The tipper will then reverse its operation and place the container on the ground. As can be appreciated, the design and the configuration of the tipper mechanisms can vary. Also, some trucks are equipped with two tippers to provide more effective collection operations. Based upon the variations outlined above, the configuration of the truck must be able to accommodate these variations in the collection mechanisms. In many cases, this has required customization or modification to meet the needs of the collection company.

In addition to the interaction with tippers, certain refuse operators may prefer load heights at a specific level. Often these load heights will accommodate manual loading, thus it is desired to have lower load edges.

SUMMARY

To provide a refuse truck with improved durability, flexibility and efficiency several aspects of the truck design are improved in the embodiments of a refuse truck as described below. Further, several details are modified to improve the manufacturability of the refuse truck.

BRIEF DESCRIPTION OF THE DRAWINGS

Further advantages of the systems, devices and embodiments for improved operations of a refuse truck will be better understood from reading the description set forth below in conjunction with the drawings, in which.

DESCRIPTION

Figure 1:
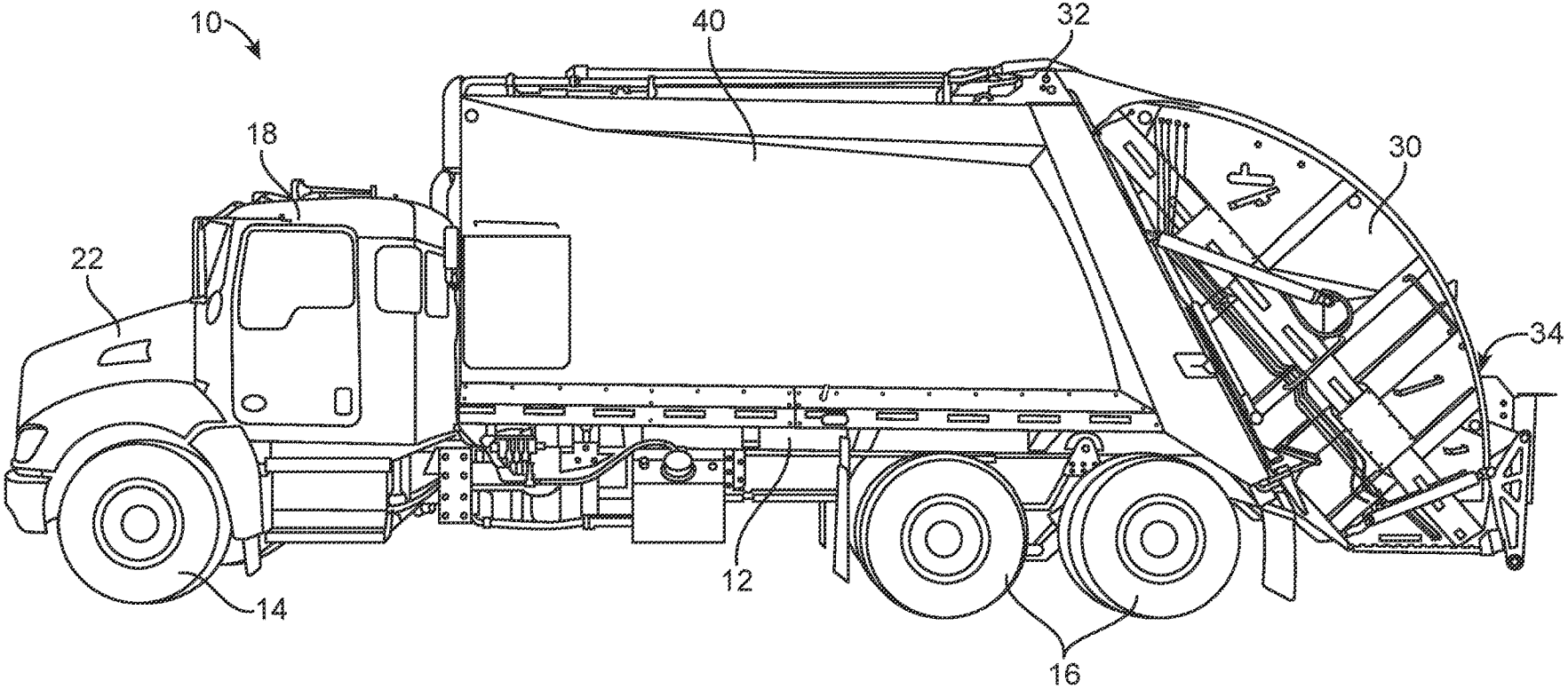
FIG. 1 is a perspective view of an exemplary refuse truck.

Existing refuse collection trucks generally come in one of many different configurations, including a front loader version, side loader version, and rear loader version. As the names suggest, variations in operation and layout drive the way these refuse vehicles operate. Turning now to FIG. 1, one example of a rear loader refuse truck is illustrated. In this embodiment, rear loader refuse truck 10 is shown having a truck frame 12 supported by a pair of front wheels 14, and a set of rear wheels 16. Frame 12 also supports a cab 18 designed to contain several operator controls. As will also be recognized, a motor or engine (not shown) is housed under a front hood 22 and is configured to supply necessary power. Further components which will be clearly understood but are not specifically illustrated include a transmission, hydraulic pumps, an electrical power supply, hydraulic power structures (tubes, valves, etc.), and other operating components. Those skilled in the art will recognize the need and general operation of these components.

Also illustrated in FIG. 1, frame 12 supports and carries a collection mechanism 30 and a main collection body 40 which is designed to define or create a main collection compartment 42. As is appreciated, collection mechanism 30 will include a bin, hopper or collection area 34 which is designed and configured to easily allow operators to deposit refuse therein. On each side of collection body 40, a set of removeable fenders 400 are attachable to a lower edge to provide protection of flat surfaces and allow design flexibility.

In operation, a sweep and scoop mechanism is used to pull refuse from the collection hopper 34 into main collection compartment 42. In addition, compaction equipment is included so refuse is compacted as collection operations occur, thereby more efficiently utilizing the space and main collection compartment 42. Further, it is typical for collection mechanism 30 to be hingably mounted to main collection body 40 at an upper hinge point 32. Based upon this connection methodology, the collection mechanism 30 can be swung upward and out of the way, thus allowing main collection compartment 40 to be easily emptied when full.

Figure 2:
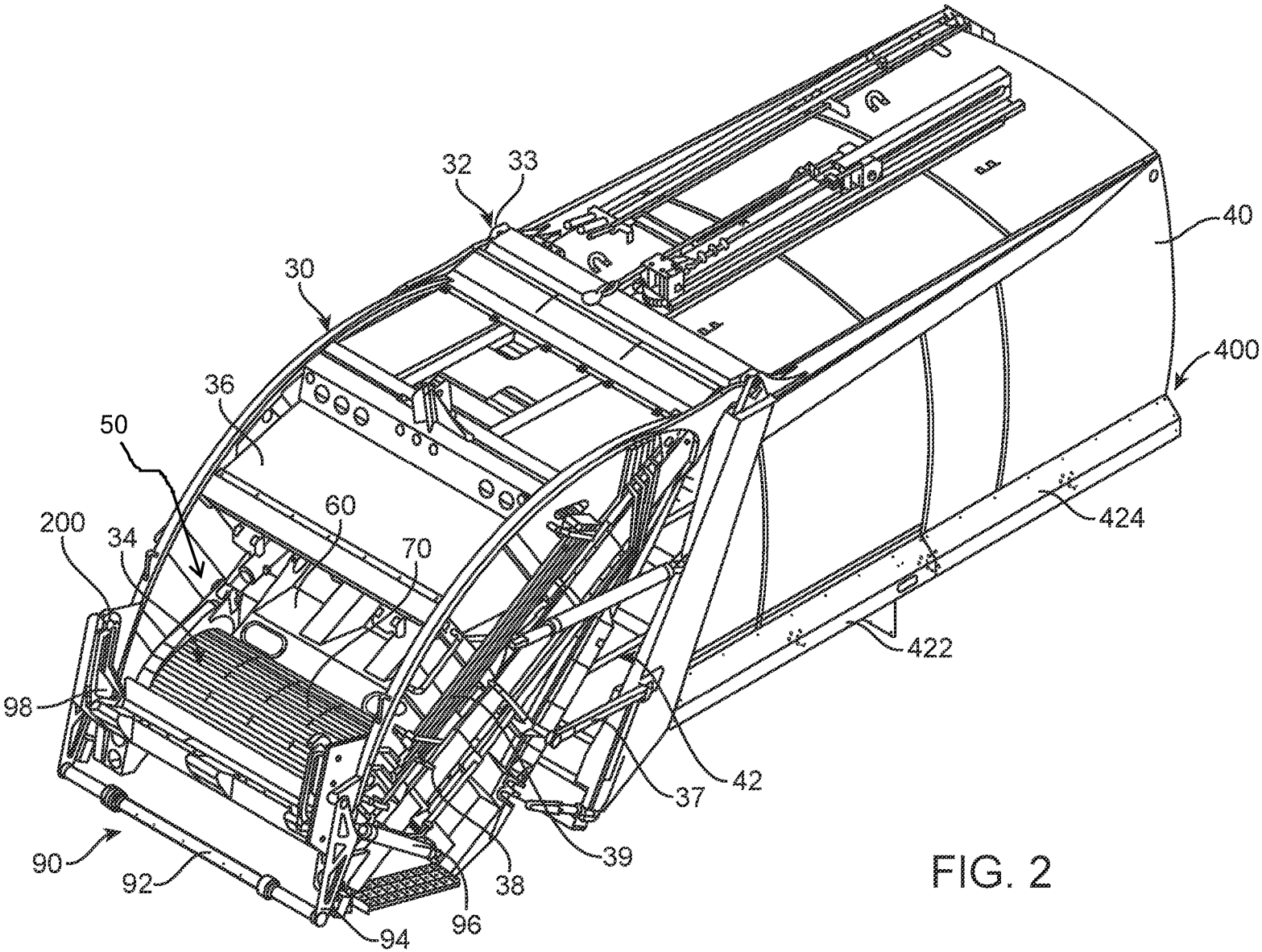
FIG. 2 shows certain details of the refuse collection systems of the exemplary refuse truck shown in FIG. 1.

As suggested above, collection mechanism 30 includes several components which are specifically designed and configured to accommodate the collection of refuse. As one example, FIG. 2 presents a perspective view of the collection mechanism 30 coupled to main collection body 40 at hinge point 32 by a hinge connection 33. In FIG. 2 collection mechanism 30 slightly pulled away from main collection body 40 thus exposing a portion of main collection compartment 42. Here, collection mechanism 42 is held in place by a lockout bar 37. It is contemplated that the hinge connection 33 is achieved by appropriate hinge pins to accommodate the hinging of collection mechanism 30 as an entire unit.

One of the operative components included as part of collection mechanism 30 is a slide and sweep mechanism 50, along with associated hydraulic cylinders and related controls. As will be further discussed below, slide and sweep mechanism 50 includes a slide panel 60 and a sweep plate 70. Those skilled in the art will recognize that slide panel 60 and sweep plate 70 are configured to slide downward into collection hopper 34 which is positioned at a lower portion of collection mechanism 30. As is well known, refuse handlers or truck operators typically place or dump refuse into collection chamber 34, either by hand or using appropriate automated mechanisms. When collection hopper 34 is relatively full actuation of slide and sweep mechanism 50 will cause the refuse contained in collection hopper 34 to be scooped inward and into main collection compartment 42. As illustrated, the collection chamber 34 is formed and defined by portions of a main housing or main body 36 which also provides support for all other components such as slide and sweep mechanism 50. Also, several controls 38 and related hydraulic tubing 39 is attached to main body 36 to accommodate operation of the various systems contained or attached thereto. In addition, a tipper mechanism 90 can be attached at a rear portion of collection mechanism 30, and includes a tipping bar 92, a hinge mechanism 94 and related hydraulic cylinders 96. This tipper system 90 allows large containers to be positioned adjacent a load edge for collection hopper 34 and can accommodate the automated tipping of these large refuse containers or collection containers (which generally are too large for physical lifting by operators). In this embodiment, it is anticipated that the large refuse container would have bars or extension that could be captured in openings 98 in the side of a rear load bracket 200. Once those bars are retained, hydraulic cylinders 96 can be activated, thus causes related movement of tipping bar 92, which would thus cause the large refuse container to be tipped so that refuse can be dumped into collection area 34. There are also accommodations for the attachment of individual tipper mechanisms (not shown) which are designed to handle smaller refuse containers, such as those maintained by residential and small commercial customers. Further details and structures related to collection mechanism 30 are discussed in detail below.

As generally discussed above in relation to FIG. 2, collection mechanism 30 has a rear load edge adjacent to collection chamber 34. The desired configuration of the rear load edge can vary, depending on the needs of various collection operators. More specifically, some operators may require the rear load edge to be situated at a specific height, while others may desire specific shapes or configurations. Additionally, several varying tipping devices can be used in refuse collection operations, each having separate configurations and mounting requirements for the rear load edge. Due to these desires and demands of the collection operators, it is beneficial to provide flexibility in the design of collection mechanism 30 and related components.

Figure 3:
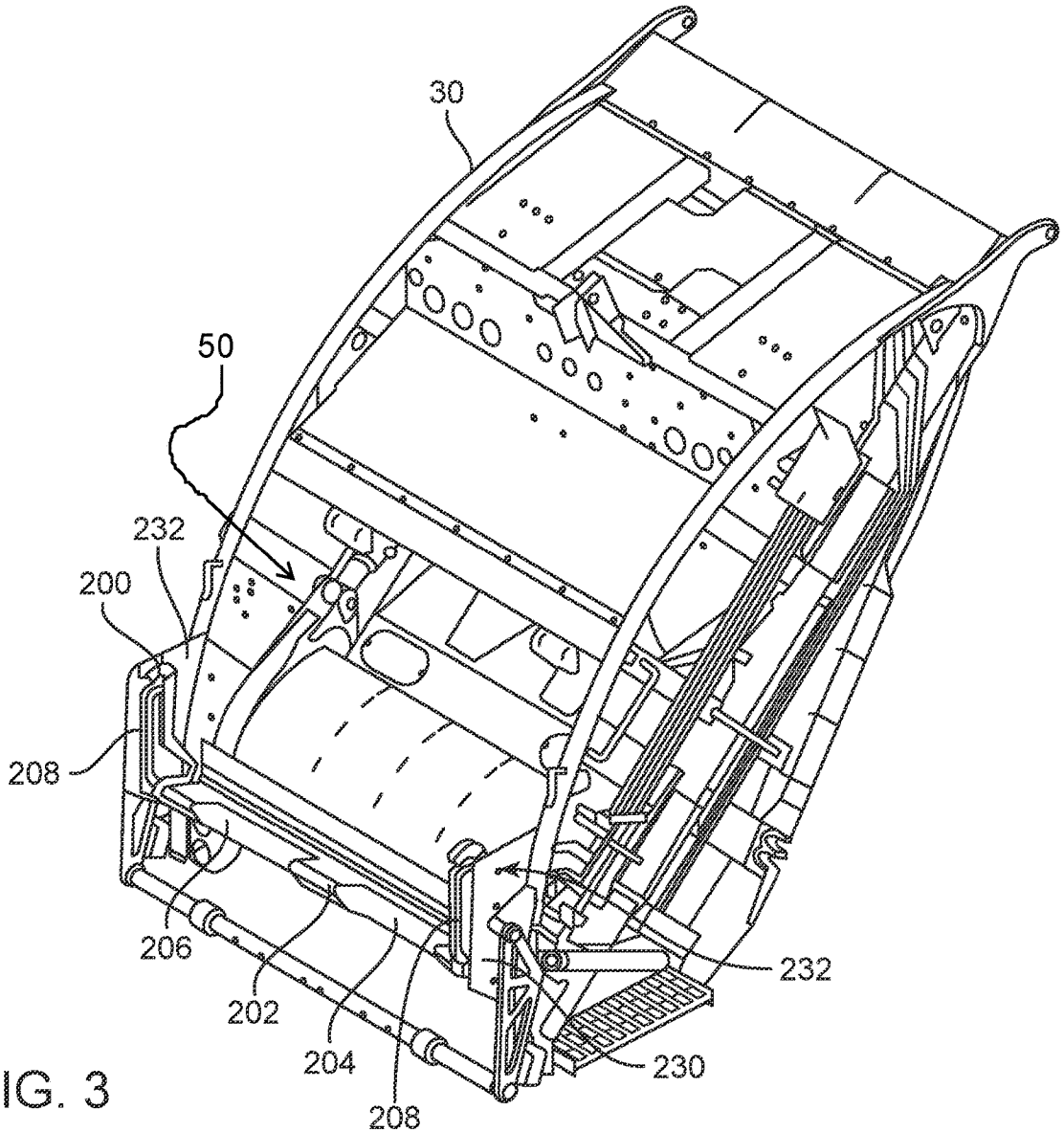
FIG. 3 illustrates one embodiment of a possible load edge bracket coupled to a collection mechanism.

In the embodiments disclosed herein, various rear load edge characteristics are achieved by providing a separate detachable rear load edge bracket. FIG. 3 more specifically illustrates a rear portion of refuse truck 10 and collection mechanism 30. As shown, a first rear load edge bracket 200 is mounted and attached to collection mechanism 30. As illustrated, first rear load edge bracket 200 includes a pair of collection bracket uprights 208 and a related cross member or horizontal portion 202 extending between uprights 208. Collection bracket uprights 208 further include mounting structures to allow attachment to a pair of rear brackets or plates 230, 232 which are part of collection mechanism 30. These mounting structures cooperate with various holes 234 in rear brackets 230, 232 thus allowing mounting at various heights and in different positions. As further illustrated, collection uprights 208 include openings 98 referenced above, which will help with the tipping of large refuse containers. In this embodiment, a horizontal portion 202 of first load edge bracket 200 includes a first recess 204 and a second recess 206 which are specifically spaced and configured to receive cooperating individual tipper mechanisms (not shown). It is contemplated that this configuration would allow for the attachment of two separate tippers mechanisms, thus allowing two corresponding small collection containers (e.g. residential collection containers) to be dumped at once. Those skilled in the art will appreciated that these separate tipper mechanisms are often "after-market" components which come in different configurations but can typically be fit to the rear edge of refuse vehicles. That said, the mounting configurations and details can vary. The use of a separate load edge bracket 200 allows these separate tipper mechanisms to be easily attached. In some embodiments a specifically designed load edge bracket can be developed and used for each of the various alternative tipper mechanisms.

In the embodiment illustrated in FIG. 3, mounting plate 230 is shown having multiple mounting holes pre-drilled therein which allow first rear load edge bracket 200 to be mounted at different heights. As will be appreciated, this same mechanism allows for any alternative brackets to similarly be mounted at different heights.

Figure 4:
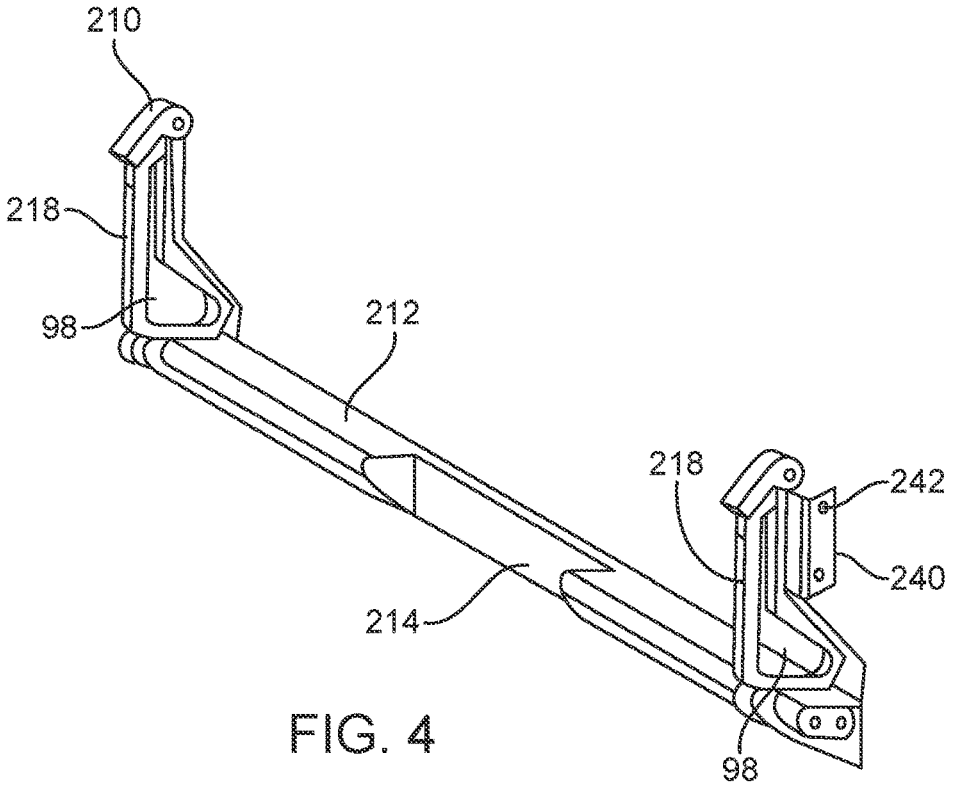
FIG. 4 shows another embodiment of an alternative load edge bracket.

FIG. 4 shows a second rear load edge bracket 210 having a slightly different configuration. Second rear load edge bracket 210 has a horizontal portion 212 having only a single recess 214. It is contemplated that second rear load edge bracket 210 could be mounted at alternative heights (as discussed above) but is also configured to accommodate the attachment of a single tipper mechanism. In this case, the single tipper mechanism would be centrally located, and easily accessible by an operator. Second rear load edge bracket 210 further has uprights 218 which include openings 98 that help support tipping of large refuse container (as discussed above). FIG. 4 further shows a mounting bracket 240 coupled to upright 218 which includes a set of mounting holes 242. As will be recognized, mounting holes 242 will cooperate with related holes 234 in rear bracket 232. Although not shown, it is contemplated that a similar mounting brackets and mounting holes will exist on an opposite side of second rear bracket 210. By providing a number of different mounting holes at different locations, the height of rear load edge bracket 210 can be easily adjusted during a final assembly step.

Figure 5:
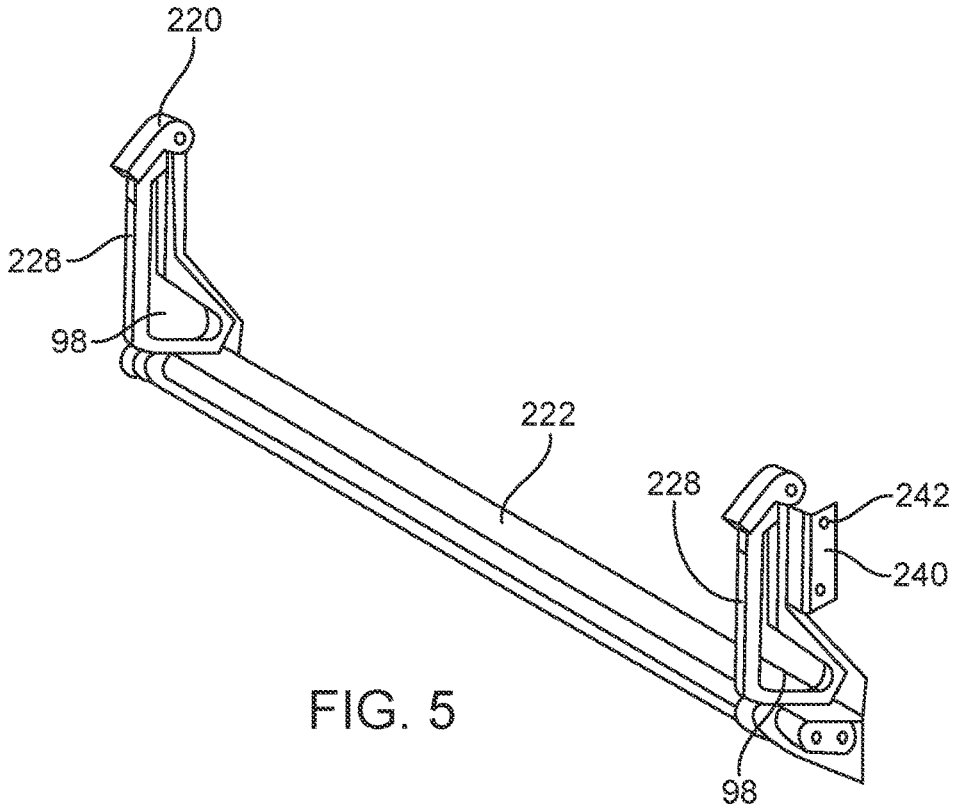
FIG. 5 presents yet another embodiment of a load edge bracket.

Alternatively, a third rear load edge bracket 220 is presented in FIG. 5. In this embodiment, third rear load edge bracket 220 has a horizontal portion 222 that does not have recesses, but has similar uprights 228 which also have mounting brackets 240 attached thereto. This embodiment would be used when a refuse collection organization simply contemplates manual loading and dumping of refuse container. Clearly, this provides operators with flexibility and a clear area at the rear of the collection mechanism 30.

FIGS. 3-5 illustrate how the used of different rear load edge brackets (200, 210, 220, etc.) allows collection vehicles to be easily configured in different manners which will meet the needs and desires of the particular collection company. It is further contemplated that several alternatives could easily be used, depending on the needs and other components utilized or requested by the refuse collection company.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A refuse collection system for use in a refuse truck, comprising:

a collection body forming an enclosed refuse containing compartment having a receiving opening;

a collection mechanism hingably coupled to the collection body and positioned adjacent the receiving opening, the collection mechanism having a collection compartment defined by a bottom surface, a first sidewall and a second sidewall, wherein the first sidewall and the second sidewall are substantially parallel to one another and are positioned on opposite sides of the bottom surface, and the collection mechanism further having a slide and sweep system movable along a predetermined path so as to move refuse placed on the bottom surface from the collection compartment into the refuse containing compartment; and a removable single piece load edge bracket coupled to a rear portion of the collection mechanism which is adjacent the collection compartment, wherein the load edge bracket comprises a cross member, a first upright extension and a second upright extension, with the first upright extension and the second upright extension being on opposite ends of the cross member, wherein a top edge of the cross member forms a top load edge and wherein the first upright extension and the second upright extension each include openings to accommodate attachment to an inner surface of a rearwardly extending portion of the first sidewall and an inner surface of a rearwardly extending portion of the second sidewall, respectively, wherein the rearwardly extending portion of the first sidewall and the rearwardly extending portion of the second sidewall each include a plurality of holes configured to be selectively aligned with the openings in the first upright extension and the second upright extension, thereby allowing the load edge bracket to be positionable such that the top load edge is situated at a predetermined height, wherein the first upright extension and the second upright extension are substantially vertical when coupled to the collection mechanism.

2. The refuse collection system of claim 1 wherein the load edge bracket has at least one recess therein configured to accommodate the attachment of a tipper mechanism.

3. The refuse collection system of claim 2 wherein the at least one recess is positioned at a central portion thereby allowing the tipper mechanism to cause a refuse container to be tipped so that refuse is dumped into a central portion of the collection compartment.

4. The refuse collection system of claim 1 wherein each of the first upright extension and the second upright extensions include a plate having a plurality of selectable mounting holes to accommodate attachment of the load edge bracket at varying heights.

5. The refuse collection system of claim 4 wherein the plates of the single piece load edge bracket are configured to be situated in a plane normal to a central axis of the cross member.

6. The refuse collection system of claim 1 further comprising a large container tipping system coupled to the collection mechanism, the large container tipping system comprising a retaining system within each of the first uprights extension and the second upright extension for capturing a portion of a large refuse container and a tipping bar coupled to the rearwardly extending portion of the first sidewall and the rearwardly extending portion of the second sidewall, the tipping bar movable between a stowed position and a tipping position, wherein movement of the tipping bar will cause the large refuse container to be tipped so that refuse is dumped into the collection compartment.

7. The refuse collection system of claim 6 wherein the load edge bracket has at least one recess therein configured to accommodate the attachment of a tipper mechanism.

8. The refuse collection system of claim 7 wherein the at least one recess is positioned at a central portion thereby allowing the tipper mechanism to cause a refuse container to be tipped so that refuse is dumped into a central portion of the collection compartment.

9. The refuse collection system of claim 1 wherein the single piece load edge bracket is selected from a set of load-edge brackets, wherein the set comprises a first load edge bracket having a substantially continuous horizontal portion, a second load edge bracket having one recess in the horizontal portion configured to accommodate the attachment of a single tipper mechanism, and a third load edge bracket having a pair of recesses in the horizontal portion configured to accommodate the attachment of a pair of tipper mechanisms.

10. A refuse collection vehicle, comprising:

a vehicle framework;

a main collection body supported by the vehicle framework having a main storage compartment therein and an opening allowing access to the main storage compartment;

a collection mechanism coupled to the main collection body at a location adjacent to the opening, the collection mechanism having a collection hopper at an outer portion thereof opposite the opening to the main storage compartment, the collection hopper having a hopper bottom surface and a pair of substantially vertical sidewalls, wherein the collection mechanism is further configured to have a pair of collection hopper brackets which are comprised of portions of the substantially vertical sidewalls, extend toward the rear of the collection mechanism and are in-line with the vertical sidewalls, and wherein the collection hopper brackets further have a plurality of openings therein; and a single piece bolt-on load edge bracket coupled to the pair of hopper brackets, the load edge bracket comprising a horizontal portion and a pair of upright extensions positioned at opposite ends of the horizontal portion, wherein a top edge of the horizontal portion forms a top load edge and wherein each of the pair of upright extensions have a plurality of openings which are configured to cooperate with select ones of the plurality of openings in to the pair of collection brackets extending from the of the collection hopper brackets, thereby causing each of the pair of upright extensions to be substantially vertical when coupled to the collection mechanism and further allowing the bolt-on load edge bracket to be positioned at a plurality of locations to thereby position the top load edge at a predetermined height.

11. The refuse collection vehicle of claim 10 wherein the load edge bracket has at least one recess in the horizontal portion configured to accommodate attachment of a tipper mechanism.

12. The refuse collection vehicle of claim 11 wherein the recess is positioned at a central portion thereby allowing the tipper mechanism to cause a refuse container to be tipped so that refuse is dumped into a central portion of the collection compartment.

13. The refuse collection vehicle of claim 11 wherein the recess is positioned at an offset location thereby accommodating operation of the tipper mechanism to cause a refuse container to be tipped so that refuse is dumped into an offset portion of the collection compartment and the remainder of the load edge is free from obstructions so as to more easily accommodate manual loading.

14. The refuse collection vehicle of claim 10 wherein the horizontal portion is substantially continuous.

15. The refuse collection vehicle of claim 10 wherein the horizontal portion has a plurality of recesses configured to accommodate attachment of a plurality of tipper mechanisms.

16. The refuse collection vehicle of claim 10 further comprising a large container tipping system coupled to the collection mechanism, the large container tipping system further comprising a retaining system for capturing a portion of a large refuse container formed as a part of the pair of upright extensions and a tipping bar coupled to the pair of hopper brackets and movable between a stowed position and a tipping position, wherein movement of the tipping bar will cause the large refuse container to be tipped so that refuse is dumped into the collection compartment.

17. The refuse collection system of claim 16 wherein the load edge bracket has at least one recess therein configured to accommodate attachment of a tipper mechanism.

18. The refuse collection system of claim 17 wherein the at least one recess is positioned at a central portion thereby allowing the tipper mechanism to cause a refuse container to be tipped so that refuse is dumped into a central portion of the collection compartment.

19. The refuse collection vehicle of claim 10 wherein the bolt-on load edge bracket further comprises a pair of attachment plates coupled to the pair of upright extensions, with the pair of attachment plates being situated in a plane normal to a central axis of the horizontal portion.

20. The refuse collection vehicle of claim 10 wherein the bolt-on load edge bracket is selected from a set of load-edge brackets, wherein the set comprises a first load edge bracket having a substantially continuous horizontal portion, a second load edge bracket having one recess in the horizontal portion configured to accommodate attachment of a single tipper mechanism, and a third load edge bracket having a pair of recesses in the horizontal portion configured to accommodate attachment of a pair of tipper mechanisms.

* * * * *